US009097266B2

(12) United States Patent
Lin

(10) Patent No.: US 9,097,266 B2
(45) Date of Patent: Aug. 4, 2015

(54) CANOPY ASSEMBLY FOR A CEILING FAN

(71) Applicant: Hsun-Yu Lin, Taichung (TW)

(72) Inventor: Hsun-Yu Lin, Taichung (TW)

( * ) Notice: Subject to any disclaimer, the term of this patent is extended or adjusted under 35 U.S.C. 154(b) by 8 days.

(21) Appl. No.: 14/208,335

(22) Filed: Mar. 13, 2014

(65) Prior Publication Data

US 2015/0176604 A1 Jun. 25, 2015

(30) Foreign Application Priority Data

Dec. 24, 2013 (TW) ..... 102224304 A

(51) Int. Cl.

| | |
|---|---|
| ***B42F 13/00*** | (2006.01) |
| ***F04D 29/64*** | (2006.01) |
| ***F16M 13/02*** | (2006.01) |
| ***F04D 19/00*** | (2006.01) |
| ***F04D 29/66*** | (2006.01) |

(52) U.S. Cl.

CPC ..... *F04D 29/646* (2013.01); *F04D 19/002* (2013.01); *F04D 29/668* (2013.01); *F16M 13/027* (2013.01)

(58) Field of Classification Search

CPC ..... E04B 9/006; E04B 9/18; F21V 25/088; F04D 25/088; F04D 29/646

USPC ..... 248/342, 343; 416/244 R

See application file for complete search history.

(56) References Cited

U.S. PATENT DOCUMENTS

| | | | | |
|---|---|---|---|---|
| 5,613,832 | A * | 3/1997 | Su | 416/244 R |
| 5,988,580 | A * | 11/1999 | Bucher et al. | 248/343 |
| 6,439,527 | B1 * | 8/2002 | Lin | 248/343 |
| 6,790,008 | B1 * | 9/2004 | Huang | 416/244 R |
| 7,249,744 | B2 * | 7/2007 | Bacon et al. | 248/343 |
| 7,261,520 | B2 * | 8/2007 | Wang | 416/244 R |
| 7,621,498 | B2 * | 11/2009 | Tang | 248/343 |
| 7,887,293 | B2 * | 2/2011 | Frampton et al. | 416/5 |
| 8,215,920 | B2 * | 7/2012 | Criner et al. | 416/244 R |
| 8,336,844 | B2 * | 12/2012 | Pearce | 248/345 |
| 8,418,981 | B1 * | 4/2013 | Lowe et al. | 248/342 |
| 8,529,213 | B2 * | 9/2013 | Yao | 416/244 R |

* cited by examiner

*Primary Examiner* — Shin Kim

(74) *Attorney, Agent, or Firm* — Trop, Pruner & Hu, P.C.

(57) ABSTRACT

A canopy assembly includes a bracket, a canopy, a plurality of screws, two biasing members and an annular decorative ring. The canopy has two locking sections and two installation sections. Each of the installation sections has a limit wall and an abutment wall connected to the limit wall and cooperating with the limit wall to define an installation groove. Each of the biasing members includes an elastic plate engaging a respective one of the installation grooves and a protrusion formed on the elastic plate. The annular decorative ring covers the screws and has two engaging segments. Each of the engaging segments is formed with a groove engaged with the protrusion of a respective one of the biasing members.

7 Claims, 7 Drawing Sheets

CANOPY ASSEMBLY FOR A CEILING FAN

CROSS-REFERENCE TO RELATED APPLICATION

This application claims priority of Taiwanese Patent Application No. 102224304, filed on Dec. 24, 2013.

BACKGROUND OF THE INVENTION

1. Field of the Invention

This invention relates to a canopy assembly, more particularly to a canopy assembly for a ceiling fan.

2. Description of the Related Art

Referring to FIG. 1, U.S. Pat. No. 5,988,580 discloses a conventional canopy assembly for use in a ceiling fan. The canopy assembly disclosed herein includes a bracket (not shown), a canopy 8 surrounding the bracket, a plurality of mounting screws 6 used for connecting threadedly an upper portion of the canopy 8 to the bracket, and an annular ring 7 made of a resilient material and covering the upper portion of the canopy 8. Each of the mounting screws 6 has a head 61 exposed from the canopy 8 and covered by the annular ring 7. The annular ring 7 has an inner surrounding surface formed with a plurality of J-shaped recesses 71. Each of the recesses 71 of the annular ring 7 is dimensioned to receive the head 61 of a respective one of the mounting screws 6, and has a vertical section that is formed with a top opening 711 and a horizontal section that is formed with a blind end 712. During assembly of the conventional canopy assembly, the annular ring 7 is placed at a position where the top opening 711 of each of the recesses 71 is in alignment with the head 61 of the respective one of the mounting screws 6. After the annular ring 7 is moved upwardly and the heads 61 of the mounting screws 6 enter respectively the top openings 711, the annular ring 7 is rotated such that the heads 61 are accommodated in the blind ends 712 of the recesses 71, thereby securing the annular ring 7 to the upper portion of the canopy 8.

Referring to FIG. 2, U.S. Pat. No. 7,261,520 discloses another conventional canopy assembly for use in a ceiling fan. In this disclosure, the connection structure of a canopy 8' and an annular ring 7' is different from the abovementioned structure. The canopy 8' has a plurality of indentations 81'. The annular ring 7' includes a sidewall 72' and a plurality of fingers 73'. Each of the fingers 73' has a lower end affixed to the sidewall 72' of the annular ring 7', and an upper end cooperating with the sidewall 72' to define a gap therebetween and formed with a protrusion 731' for engagement with a respective one of the indentations 81'. The fingers 73' and the sidewall 72' are formed as one piece, and each of the fingers 73' is resiliently deformable relative to the sidewall 72' so as to facilitate the installation of the annular ring 7'. However, during assembly, the fingers 73' may break since the structure at the intersection between the fingers 73' and the sidewall 72' is relatively weak. Moreover, since vibrations are created, when the ceiling fan operates, if the size of the protrusions 731' and that of the indentations 81' do not match precisely, the fingers 73' may vibrate with respect to the sidewall 72' and generate undesirable noise.

SUMMARY OF THE INVENTION

Therefore, the object of the present invention is to provide a canopy assembly for a ceiling fan that can overcome at least one of the aforesaid drawbacks of the prior art.

According to this invention, a canopy assembly is adapted for use in a ceiling fan. The canopy assembly includes a bracket, a canopy, a plurality of screws, two biasing members and an annular decorative ring. The canopy surrounds the bracket and has an upper end portion having two locking sections and two installation sections that interconnect the locking sections. The locking sections and the installation sections are alternately arranged. Each of the installation sections has a limit wall and an abutment wall connected to the limit wall and cooperating with the limit wall to define an installation groove. The screws secure threadedly the locking sections of the canopy to the bracket and each has a head exposed from the locking sections of the canopy. The biasing members are attached respectively on the installation sections of the canopy. Each of the biasing members includes an elastic plate and at least one protrusion. The elastic plate engages the installation groove of the respective one of the installation sections. The protrusion is formed on the elastic plate and is exposed from the respective one of the installation sections. The annular decorative ring surrounds the upper end portion of the canopy, covers the head of each of the screws and the biasing members, and has two engaging segments registered respectively with the installation sections of the upper end portion of the canopy. Each of the engaging segments is formed with a groove engaged with the protrusion of a respective one of the biasing members.

BRIEF DESCRIPTION OF THE DRAWINGS

Other features and advantages of the present invention will become apparent in the following detailed description of the preferred embodiment of this invention, with reference to the accompanying drawings, in which.

DETAILED DESCRIPTION OF THE PREFERRED EMBODIMENT

Figure 1:
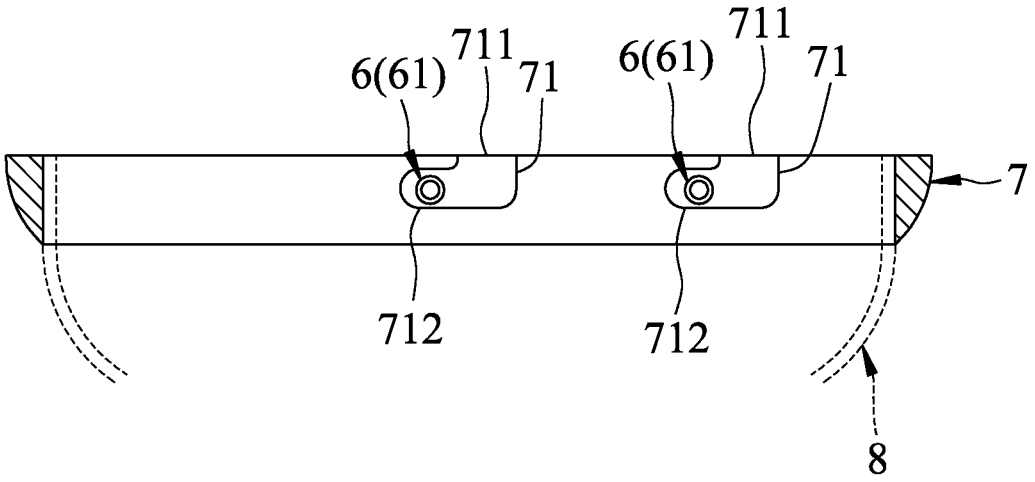
FIG.1 PRIOR ART
FIG. 1 is a fragmentary sectional view of a conventional canopy assembly for a ceiling fan illustrated in U.S. Pat. No. 5,988,580.
Figure 2:
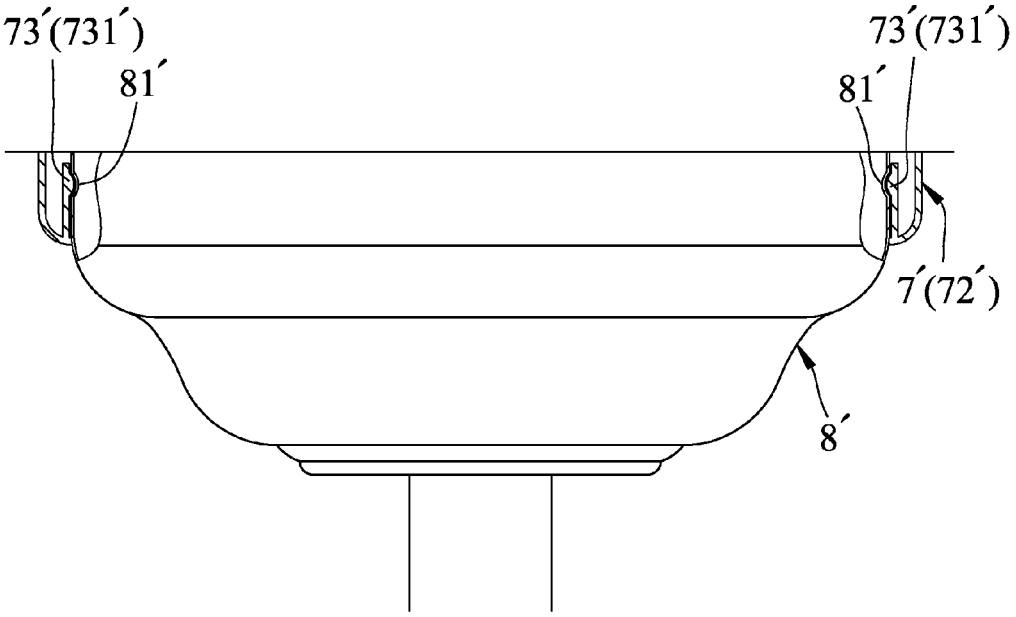
FIG.2 PRIOR ART
FIG. 2 is a partly sectional view of another conventional canopy assembly for a ceiling fan illustrated in U.S. Pat. No. 7,261,520.
Figure 3:
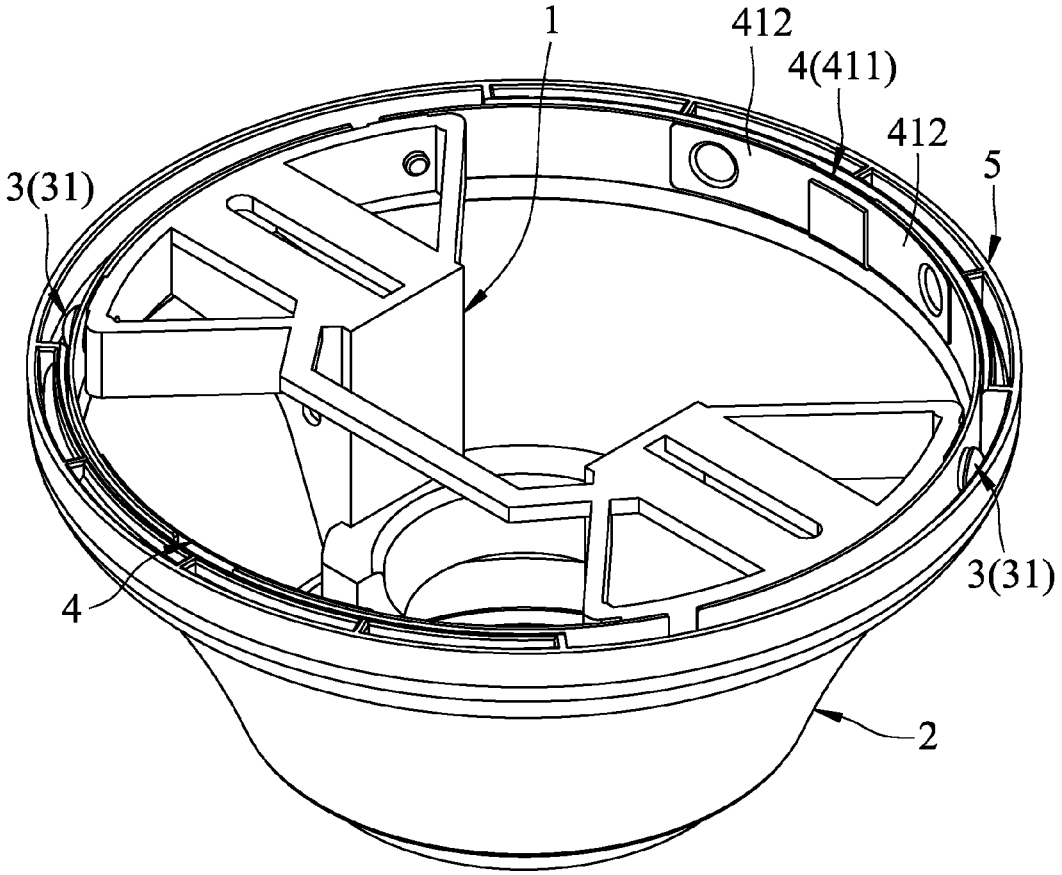
FIG. 3 is an assembled perspective view of the preferred embodiment of a canopy assembly for a ceiling fan according to this invention.
Figure 4:
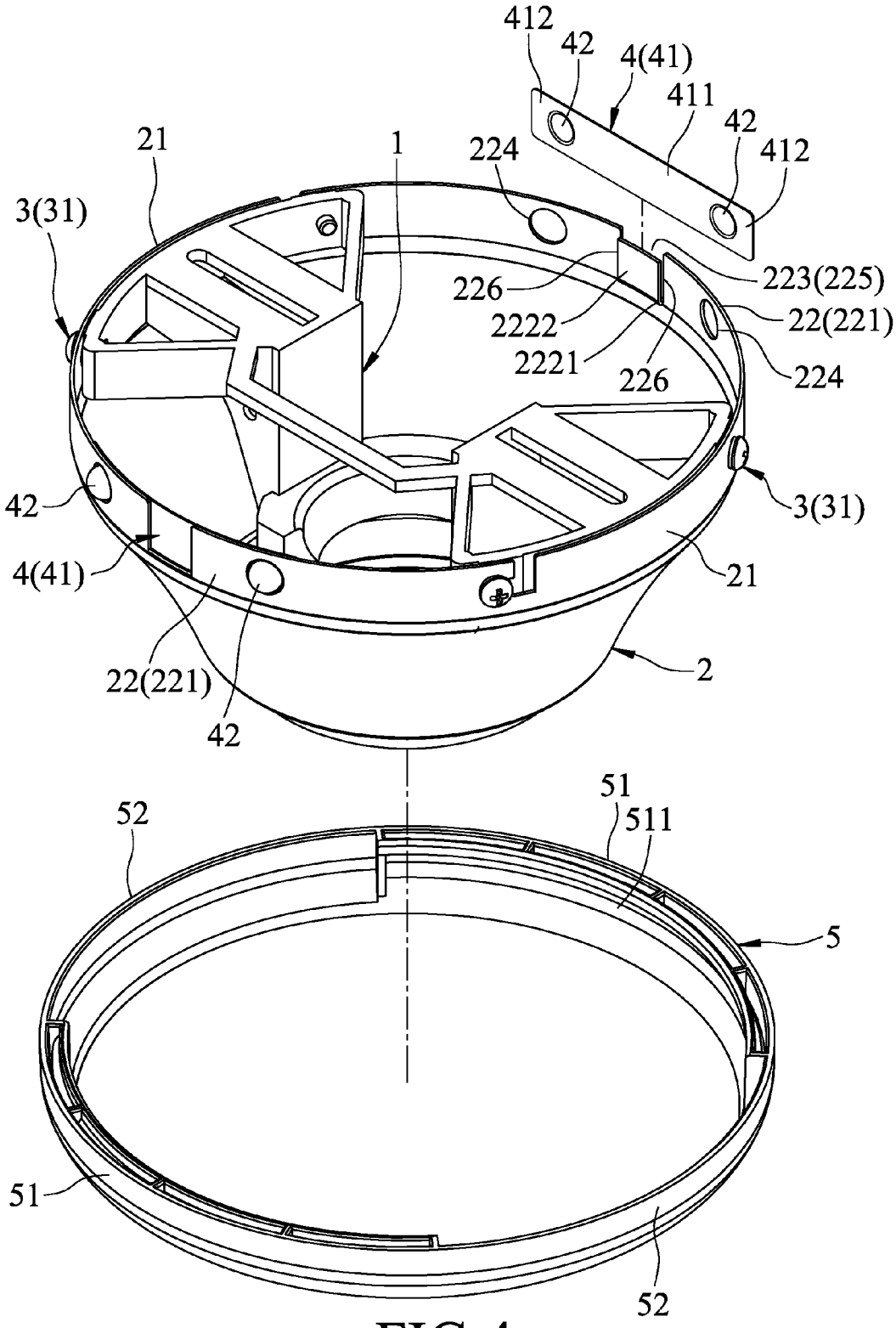
FIG. 4 is a partly exploded perspective view of the preferred embodiment.
Figure 5:
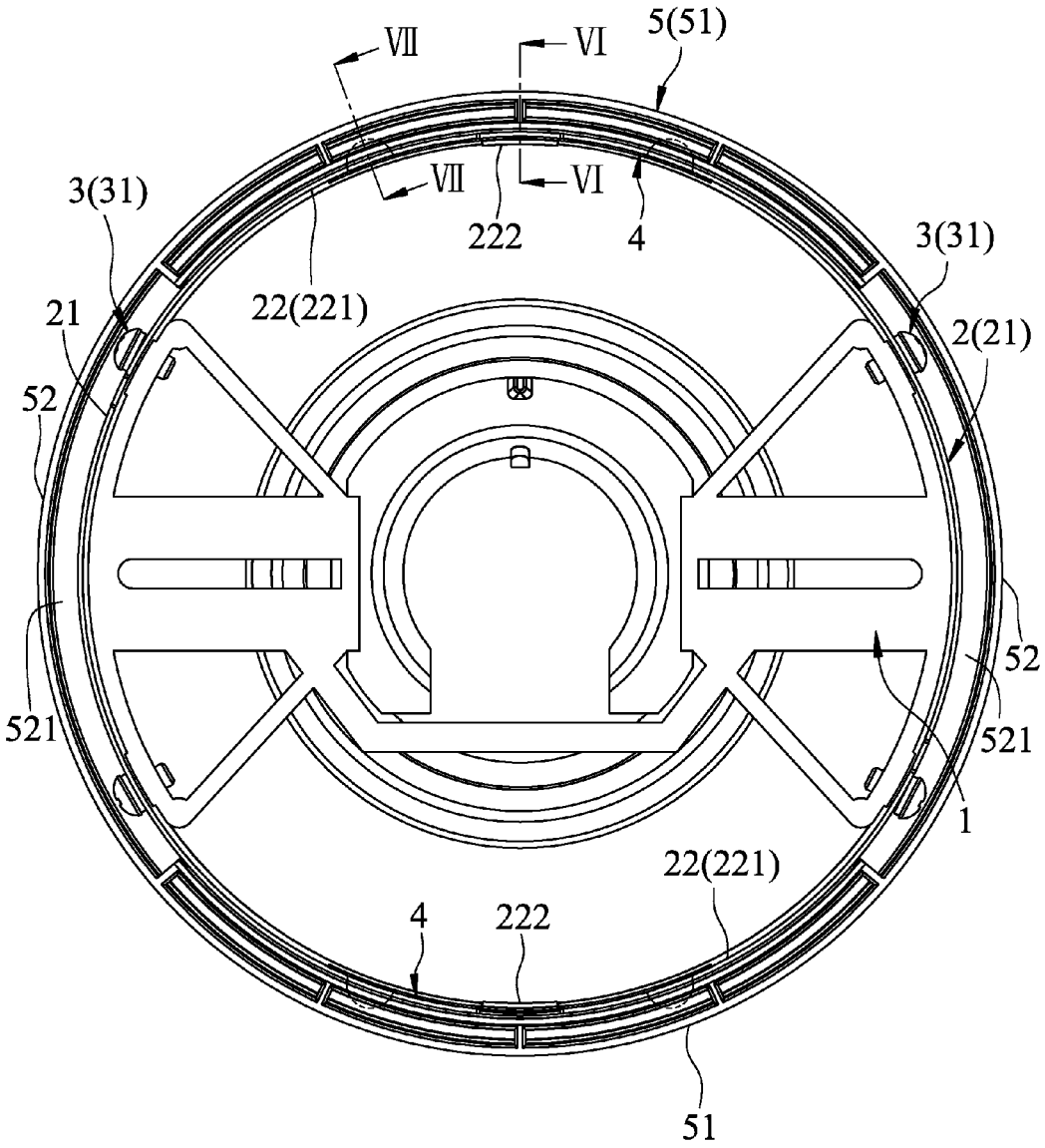
FIG. 5 is a top view of the preferred embodiment.

FIGS. 3 to 5 show the preferred embodiment of a canopy assembly according to the present invention. The canopy assembly is adapted for use in a ceiling fan and includes a bracket 1, a canopy 2, a plurality of screws 3, two biasing members 4 and an annular decorative ring 5.

The canopy 2 surrounds the bracket 1 and has an annular upper end portion having two locking sections 21 and two installation sections 22 that interconnect the locking sections 21. The locking sections 21 and the installation sections 22 are alternately arranged. Each of the installation sections 22 has a limit wall 221 and an abutment wall 222 connected to the limit wall 221 and cooperating with the limit wall 221 to define an installation groove 223. The limit wall 221 of each of the installation sections 22 is formed with two through holes 224. The abutment wall 222 of each of the installation sections 22 has a bottom wall segment 2221 extending radially and inwardly from the limit wall 221, and an abutment wall segment 2222 bent upwardly from a distal end of the bottom wall segment 2221. The installation groove 223 of each of the installation sections 22 has an upper opening 225 opposite to the bottom wall segment 2221 and opposite lateral openings 226 being in spatial communication with the upper opening 225. In this embodiment, a blank wall is punched radially and inwardly to be divided into the limit walls 221 and the abutment walls 222. That is, for each of the installation sections 22, the abutment wall 222 is disposed at a radially inner side of the limit wall 221. In addition, the abutment wall 222 has a length in a circumferential direction of the upper end portion of the canopy 2 shorter than that of the limit wall 221.

The screws 3 secure threadedly the locking sections 21 of the upper end portion of the canopy 2 to the bracket 1 and each has a head 31 exposed from the locking sections 21 of the canopy 2.

Figure 6:
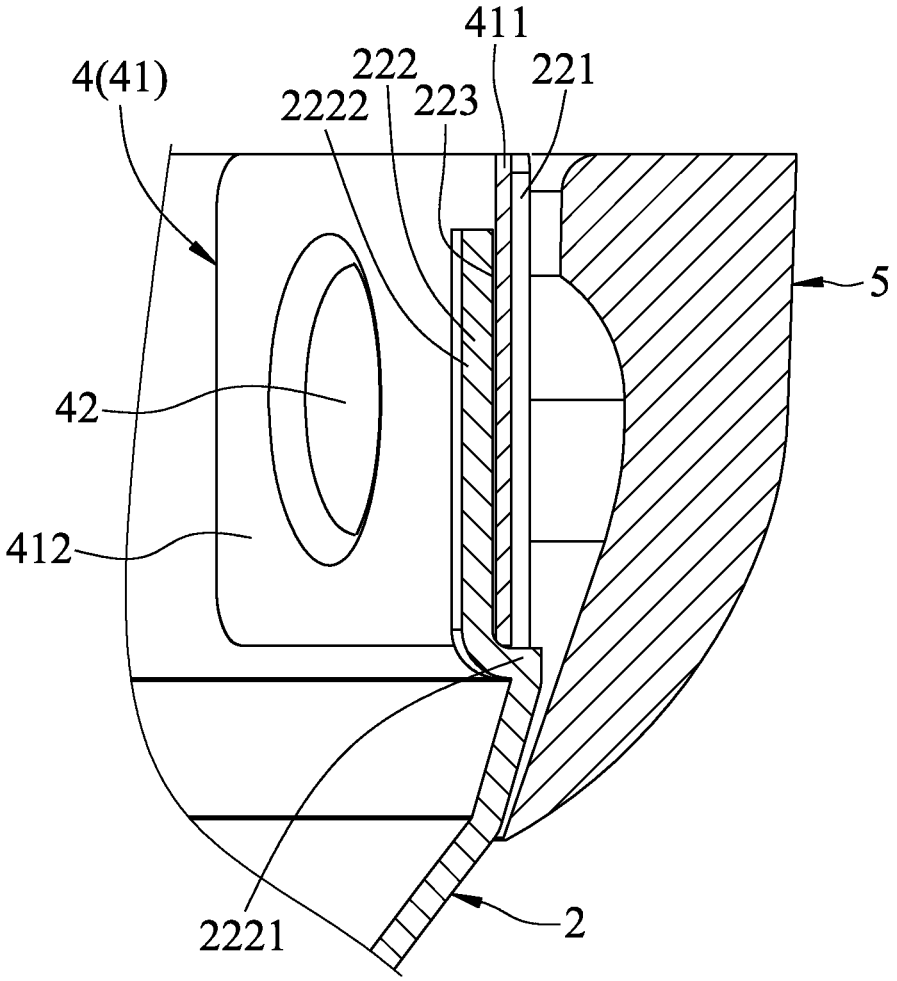
FIG. 6 is a fragmentary sectional view of the preferred embodiment taken along line VI-VI in FIG. 5.
Figure 7:
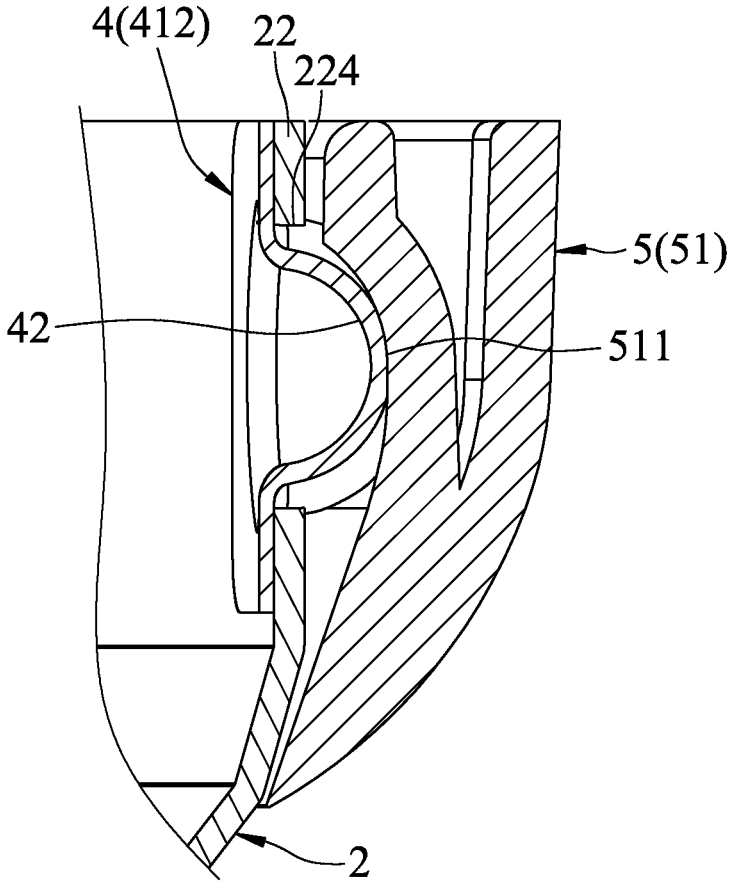
FIG. 7 is a fragmentary sectional view of the preferred embodiment taken along line VII-VII in FIG. 5.

Referring to FIGS. 4, 6 and 7, the biasing members 4 are attached respectively on the installation sections 22 of the canopy 2. Each of the biasing members 4 includes an elastic plate 41 and two protrusions 42. The elastic plate 41 of each of the biasing members 4 is inserted into the installation groove 223 of the respective one of the installation sections 22 through the upper opening 225 of the installation groove 223, and has a main portion 411 supported by the abutment wall 222 of the respective one of the installation sections 22, and two extending portions 412 extending from the main portion 411 and respectively through the lateral openings 226 of the installation groove 223. The protrusions 42 are formed respectively on the extending portions 412 of the elastic plate 41, are exposed from the respective one of the installation sections 22, and are biased by a radially-outward resilient force of the elastic plate 41 to engage firmly and respectively the through holes 224 of the limit wall 221 of the respective one of the installation sections 22. In this embodiment, each of the elastic plates 41 is urged by the limit wall 221 of the respective one of the installation sections 22 to bent resiliently along a periphery of the respective one of the installation sections 22 so that a potential energy is generated inside the elastic plate 41 for providing the radially-outward resilient force. Although the number of the protrusions 42 of each of the biasing members 4 is two according to this embodiment, it is noted that the number may vary according to different requirements.

Referring to FIGS. 4, 5 and 7, the annular decorative ring 5 surrounds the upper end portion of the canopy 2, covers the head 31 of each of the screws 3 and the biasing members 4, and has two engaging segments 51 registered respectively with the installation sections 22 of the upper end portion of the canopy 2, and two covering segments 52 registered respectively with the locking sections 21 of the canopy 2 and interconnecting the engaging segments 51. The engaging segments 51 and the covering segments 52 are alternately arranged. Each of the engaging segments 51 is formed with a groove 511 engaged with the protrusion 42 of a respective one of the biasing members 4 and extending parallel to a periphery of the annular decorative ring 5. Each of the covering segments 52 has an inner surrounding surface disposed at a radially-outward position relative to that of the engaging segments 51, cooperating with the engaging segments 51 and a respective one of the locking sections 21 of the canopy 2 to define a receiving space 521 that accommodates the heads 31 of the screws 3 which are located on the respective one of the locking sections 21, and having an arc length that is greater than a distance between two opposite outermost ones of the screws 3 which are located on the respective one of the locking sections 21 and along an outer surface of the respective one of the locking sections 21. In this embodiment, each of the covering segments 52 further has an outer surrounding surface. The outer surrounding surfaces of the covering segments 52 cooperate with those of the engaging segments 51 to define an annular outer surrounding surface of the annular decorative ring 5. Preferably, the annular decorative ring 5 is made of rigid material. More preferably, the annular decorative ring 5 is made of aluminum alloy.

Referring to FIGS. 4 and 7, an installation process of the annular decorative ring 5 will be depicted in detail in the following description. First, the annular decorative ring 5 is moved upwardly to surround the upper end portion of the canopy 2. Once the engaging segments 51 start to touch the protrusions 42 of the biasing members 4, since the engaging segments 51 of the annular decorative ring 5 are rigid in structure, the protrusions 42 are pushed by the engaging segments 51 so that the elastic plates 41 is further bent radially and inwardly (i.e., the extending portions 412 are further moved radially and inwardly) until the protrusions 42 are retracted into the installation sections 22 of the upper end portion of the canopy 2 so as to allow the annular decorative ring 5 to be further moved upwardly. When the grooves 511 of the engaging segments 51 are moved to a vertical position registered with the protrusions 42, the protrusions 42 of the biasing members 4 are biased by the radially-outward resilient force of the elastic plates to engage firmly the grooves 511. Therefore, the annular decorative ring 5 is mounted securely and firmly to the canopy 2.

To sum up, through the abovementioned configuration, the engagement between the protrusions 42 and the grooves 511 is relatively firm to fasten the annular decorative ring 5 tightly to the canopy 2. Therefore, the aforesaid drawbacks associated with the prior art can be avoided.

While the present invention has been described in connection with what are considered the most practical and preferred embodiments, it is understood that this invention is not limited to the disclosed embodiments but is intended to cover various arrangements included within the spirit and scope of the broadest interpretation and equivalent arrangements.

What is claimed is:

1. A canopy assembly adapted for use in a ceiling fan, said canopy assembly comprising:

a bracket;

a canopy surrounding said bracket and having an upper end portion that has two locking sections and two installation sections interconnecting said locking sections, said locking sections and said installation sections being alternately arranged, each of said installation sections having a limit wall and an abutment wall that is connected to said limit wall and that cooperates with said limit wall to define an installation groove;

a plurality of screws securing threadedly said locking sections of said canopy to said bracket and each having a head that is exposed from said locking sections of said canopy;

two biasing members attached respectively on said installation sections of said canopy, each of said biasing members including an elastic plate that engages said installation groove of the respective one of said installation sections, and at least one protrusion that is formed on said elastic plate and that is exposed from the respective one of said installation sections; and an annular decorative ring surrounding said upper end portion of said canopy, covering said head of each of said screws and said biasing members, and having two engaging segments that are registered respectively with said installation sections of said upper end portion of said canopy, each of said engaging segments being formed with a groove that is engaged with said protrusion of a respective one of said biasing members.

2. The canopy assembly as claimed in claim 1, wherein:

said abutment wall of each of said installation sections has a bottom wall segment extending inwardly from said limit wall, and an abutment wall segment bent from a distal end of said bottom wall segment;

said installation groove of each of said installation sections has an upper opening opposite to said bottom wall segment and opposite lateral openings in spatial communication with said upper opening;

said elastic plate of each of said biasing members is inserted into said installation groove of the respective one of said installation sections through said upper opening of said installation groove, and has a main portion supported by said abutment wall of the respective one of said installation sections, and two extending portions extending from said main portion and respectively through said lateral openings of said installation groove; and each of said biasing members includes two of said protrusions that are formed respectively on said extending portions of said elastic plate.

3. The canopy assembly as claimed in claim 2, wherein:

said limit wall of each of said installation sections is formed with two through holes; and said protrusions of each of said biasing members are biased by a radially-outward resilient force of said elastic plate of said biasing member to engage firmly and respectively said through holes of said limit wall of the respective one of said installation sections.

4. The canopy assembly as claimed in claim 1, wherein said groove of each of said engaging segments extends parallel to a periphery of said annular decorative ring.

5. The canopy assembly as claimed in claim 4, wherein said annular decorative ring further has two covering segments registered respectively with said locking sections of said canopy and interconnecting said engaging segments, said covering segments and said engaging segments being alternately arranged, each of said covering segments having an inner surrounding surface that is disposed at a radially-outward position relative to that of said engaging segments, that cooperates with said engaging segments and a respective one of said locking sections of said canopy to define a receiving space accommodating said head of each of said screws which are located on the respective one of said locking sections, and that has an arc length greater than a distance along an outer surface of the respective one of said locking sections between two opposite outermost ones of said screws which are located on the respective one of said locking sections.

6. The canopy assembly as claimed in claim 1, wherein said annular decorative ring is made of rigid material.

7. The canopy assembly as claimed in claim 6, wherein said annular decorative ring is made of aluminum alloy.

* * * * *